United States Patent [19]

Hayes

[11] 4,133,368

[45] Jan. 9, 1979

[54] SINGLE CRYSTAL CASTING MOLD AND METHOD FOR MAKING SAME

[75] Inventor: Douglas R. Hayes, Vernon, Conn.

[73] Assignee: United Technologies Corporation, Hartford, Conn.

[21] Appl. No.: 820,660

[22] Filed: Aug. 1, 1977

[51] Int. Cl.[2] ..... B22C 9/04; B22C 7/02

[52] U.S. Cl. ..... 164/35; 164/60; 164/235

[58] Field of Search ..... 164/14, 23- 26, 164/34, 35, 44, 45, 60, 75, 127, 132, 235, 236, 361

[56] References Cited

U.S. PATENT DOCUMENTS

| | | | |
|---|---|---|---|
| 2,770,859 | 11/1956 | Henry | 164/44 |
| 3,461,949 | 8/1969 | Nilson | 164/44 |
| 3,598,172 | 8/1971 | Copley | 164/60 |

*Primary Examiner*—Robert L. Spicer, Jr.
*Assistant Examiner*—K. Y. Lin
*Attorney, Agent, or Firm*—Edward J. Timmer

[57] ABSTRACT

An improved mold for casting single crystal metallic articles is disclosed and comprises a ceramic investment mold having a main article cavity and having embedded at its lower end below the article cavity and in communication therewith a preformed ceramic single crystal starter insert. The preformed starter insert generates a plurality of single metallic crystals in a growth cavity and then selects one crystal for further propagation through the article cavity. A method for making such a mold is also disclosed.

8 Claims, 4 Drawing Figures

FIG. 1
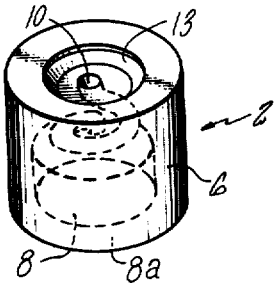
FIG. 2
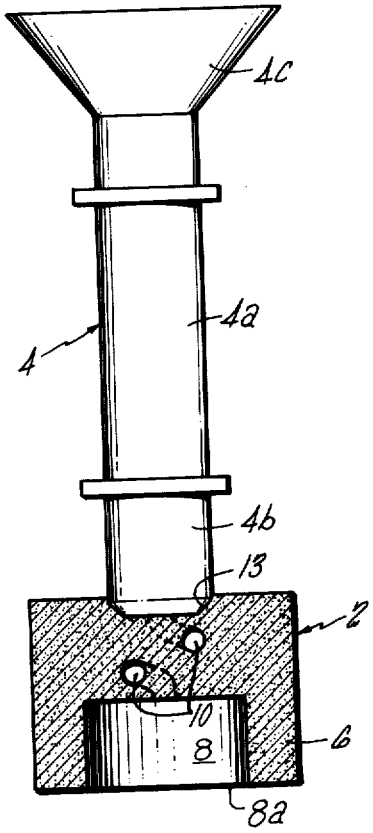
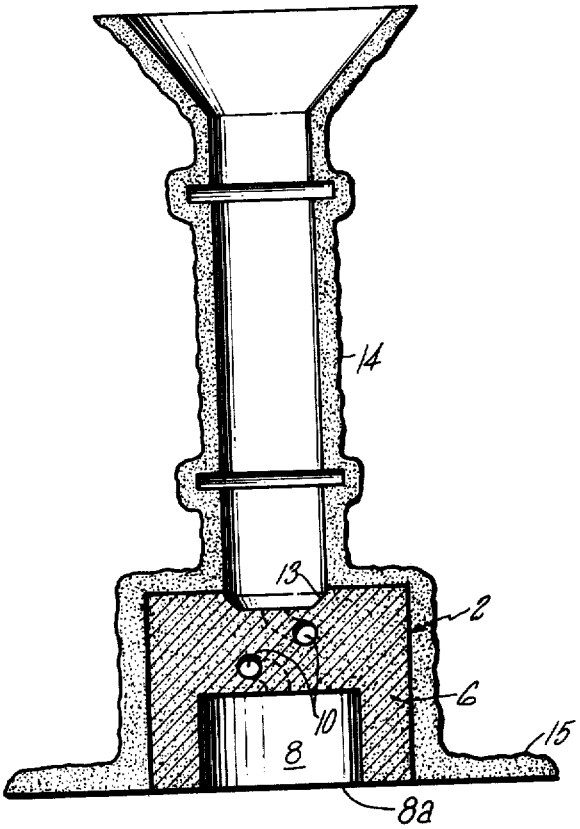
FIG. 3

SINGLE CRYSTAL CASTING MOLD AND METHOD FOR MAKING SAME

BACKGROUND OF THE INVENTION

1. Field of the Invention

The present invention is related to molds and methods for making same useful in casting single crystal metallic articles.

2. Description of the Prior Art

In casting single crystal metallic articles, a mold having a crystalline growth zone or cavity at the lower end and a narrow passage above and in communication with the growth zone is widely used such as, for example, in the Piearcey patent, U.S. Pat. No. 3,494,709 of common assignee herewith. Generally, the mold growth zone has an open bottom so that when the mold is placed on a chill plate during casting, the molten metal therein will be unidirectionally solidified to cause columnar grain growth toward the passage. The narrow passage functions to select a single crystal from among the numerous crystals growing upwardly in the growth cavity for further propagation through the mold. In the past, it has been common for the passage to take the form of a helix of small cross-section as compared to the growth cavity, such a passage being illustrated in U.S. Pat. Nos. 3,625,275; 3,627,015; 3,667,533; 3,690,368; 3,700,023 and 3,712,368, all of common assignee with the present invention.

In one prior art practice, the molds used in single crystal casting are made by the well known shell molding or "lost wax" process in which layers of ceramic material are deposited on a disposable pattern such as a wax pattern. The wax pattern generally comprises an article portion, a helix portion and a growth zone portion, the helix portion being wax welded by hand between the others. It is the assembled wax portions which are then covered with the ceramic layers to form a shell mold therearound. After the desired thickness of ceramic shell is deposited, the wax pattern is melted out, leaving behind a ceramic shell mold having an upper article cavity connected to a lower growth cavity by a helical passage of small cross-section.

As a result of the small cross-section and consequent structural weakness of the wax helix, problems have arisen during assembly of the wax pattern portions and during shell molding in the form of distortion or breakage of the helix and other wax portions. This problem requires operating personnel to use utmost care in these operations; however, notwithstanding such care, distortion and breakage of the helix occurs all too frequently and results in lower production and increased casting costs.

In another prior art practice, molds for casting single crystals are provided by assembling a precast central mold element or strongback between precast outer mold elements as shown in detail in the Hayes and Phipps patent, U.S. Pat. No. 3,965,963, of common assignee herewith. In this method, the mold elements are preformed or precast by injecting ceramic slurry into a suitably configured molding cavity.

SUMMARY OF THE INVENTION

The present invention provides an improved mold and method for making same useful in the casting of single crystal metallic articles.

Typically, the improved mold comprises a ceramic investment mold having at least one main article cavity and having embedded at its lower end below the article cavity and in communication therewith a preformed ceramic single crystal starter insert. The preformed starter insert includes a ceramic body having a crystal growth cavity at the bottom with an open bottom end to engage a chill plate and an upwardly inclined passage connecting the growth cavity to the article cavity of the mold, the passage being suitably configured to select a single metallic crystal from the growth cavity for further propagation through the article cavity.

In making such a mold, the invention typically envisions exposing the end of the starter insert opposite the growth cavity to a suitably shaped pattern mold and injecting disposable material, such as molten wax, in the mold against the end of the insert to not only form the pattern of the article to be cast but also to join or attach the pattern to the starter insert. The resultant structure of preformed starter insert and disposable article pattern is then subjected to investment molding operations to form a ceramic mold therearound, leaving the open bottom of the growth cavity exposed however. Upon removal of the disposable article pattern, a mold for use in casting single crystal metallic articles is provided.

The mold and method of the invention are particularly advantageous from the standpoint of providing a highly accurate and reproducible crystal starter in the mold while substantially reducing manual assembly and distortion and breakage of the helix. In addition, inspectability of the starter insert and the ability to adapt its configuration and structure to specific metals and articles being cast is provided.

These and other advantages and objects of the present invention will become more fully apparent from the following drawings and detailed description of the preferred embodiments.

BRIEF DESCRIPTION OF THE DRAWINGS

FIG. 1 is a perspective view of a preformed ceramic starter insert.

FIG. 2 is an elevational view showing the preformed ceramic starter insert joined to a disposable pattern, the insert being shown in section.

FIG. 3 is a sectional view of the structure of FIG. 1 after investment molding and after removal of the wax pattern.

DESCRIPTION OF THE PREFERRED EMBODIMENTS

Figure 4:
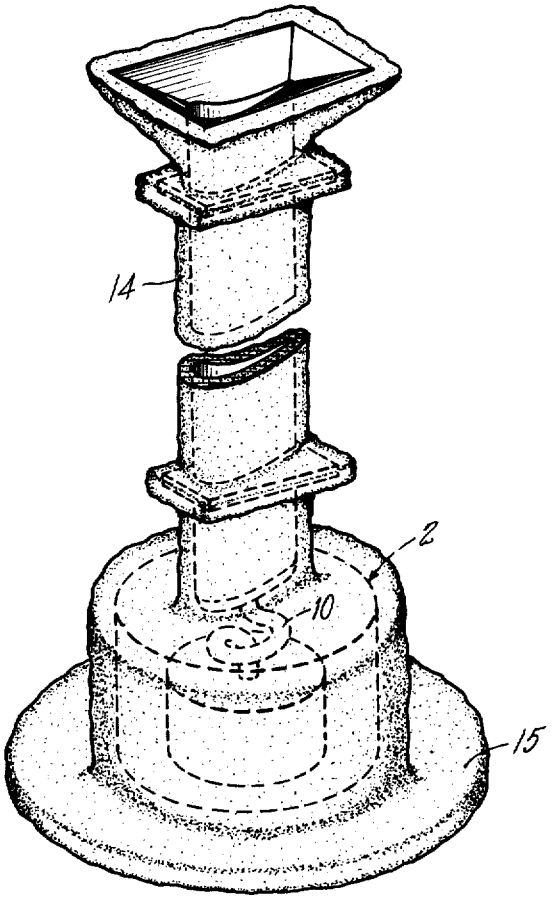
FIG. 4 is a perspective view, similar to FIG. 3, shown after investment molding and after removal of the pattern, and is partly broken away to show the airfoil section of a gas turbine blade.

Referring to FIGS. 1 and 2, a preformed ceramic single crystal starter insert 2 is shown alone and joined to a disposable pattern which, by way of illustration, is pictured as a gas turbine blade 4 having an airfoil section 4*a*, root section 4*b* and pour cup 4*c*. The starter insert includes a ceramic body 6 having a growth cavity 8 at the bottom with an open bottom end 8*a* to rest on a suitable chill plate (not shown) in conventional fashion. In communication with the top of the growth cavity and bottom of the disposable blade pattern is a helical passage 10 of small cross-section compared to the growth cavity. During casting, the helical passage functions to select a single metallic crystal from among numerous crystals growing upwardly in the growth cavity for further propagation through the article cavity, a more detailed description of the crystal formation and selection process being found in the above cited Piearcey patent, U.S. Pat. No. 3,494,709. The ceramic body may also include one or more wax drainage holes (not shown) with which removal of the disposable blade pattern is subsequently facilitated. Such holes would be vertically oriented and connect the bottom of the pattern to the growth cavity 8 to provide drainage passages. Preferably the end of the ceramic body opposite the growth cavity includes a pattern attachment surface 13 suitably shaped to receive the lower end of the root section of the blade pattern as shown.

In general, the ceramic crystal starter insert is precast in a suitable metallic die by well known high pressure or low pressure ceramic injection processes. Of course, once a suitable die is made, the insert can be produced in quantity from suitable ceramic material which can be tailored specifically to the metals being cast and mold materials being used. A typical ceramic material useful in casting nickel base alloys is a mixture comprising about 20% silica and 30% zirconia. Other materials useful for this purpose will be familiar to one skilled in the art.

The use of a preformed or precast ceramic starter insert offers several advantages among which are improved dimensional control and reproducibility and the opportunity to inspect the insert prior to its being embedded in the ceramic investment mold. In addition, the thickness of the ceramic body can be varied as desired to provide an increased insulating effect in the area of the growth cavity and helical passage to improve thermal gradients and minimize spurious crystal nucleation. Of course, the extensive manual assembly operations of the prior art are essentially eliminated. With the aid of the preformed single crystal starter insert, crystal formation and selection can be optimized to produce higher quality castings.

The preferred method for attaching the preformed starter insert to the blade pattern utilizes a metallic pattern mold having the shape of the blade to be cast, including the pour cup. In this technique, the attachment surface 13 of the starter insert is exposed to the mold interior and molten wax or other pattern material is injected therein. The blade pattern is formed to desired shape and simultaneously attached to the starter insert at surface 13 as the wax solidifies thereagainst. The structure produced by this procedure is illustrated in FIG. 2. This procedure is particularly advantageous since manual assembly of the starter insert and delicate pattern is eliminated.

After the structure of FIG. 2 is formed, it is subjected to conventional investment molding operations, including shell type or solid type investment molding, to form a ceramic mold around the structure. Of course, end 8*a* of the starter insert must remain open so that contact of the molten metal with the chill plate can be effected during casting. Consequently, it is desirable to place a flat plate over that end of the starter insert during investment molding to prevent ceramic material from closing off the opening. After molding, the plate can be easily removed.

In the shell type of investment molding, the structure is repeatedly dipped in ceramic slurry and dried until a ceramic shell of adequate thickness for a mold wall is obtained. For example, a ceramic shell mold 14 produced by this molding process is shown in FIG. 3 after removal of the blade pattern. In FIG. 3, the shell mold is shown with a base or flange portion 15 which rests on the chill plate (not shown) during directional casting.

If wax drain holes have been provided in the starter component, removal of the wax blade pattern by melting is greatly facilitated since the helical passage is quite small in cross-section and, therefore, exhibits limited drainage capacity. However, before casting, it is necessary to insert preformed ceramic plugs or the like in the drainage holes to prevent growth of metallic crystals upwardly through the holes during casting.

In the solid type of investment molding, the structure of FIG. 2 is enclosed in a container or flask and ceramic mold slurry poured therearound, leaving end 8*a* of the starter insert exposed however. After the slurry hardens, the blade pattern is removed as described above to provide the desired mold.

It has been suggested in the prior art that single crystals of nickel superalloys have particular utility when provided in the form of a gas turbine engine blade. FIG. 4 shows a mold similar to that shown in FIG. 3 but having a cavity adapted to produce an airfoil section such as might be used in a gas turbine engine.

Although the invention has been shown and described with respect to illustrative embodiments thereof, it will be understood by those skilled in the art that changes and additions in the form and detail thereof may be made without departing from the spirit and scope of the invention.

Having thus described a typical embodiment of my invention, that which I claim as new and desire to secure by Letters Patent of the United States is:

1. A ceramic mold for casting single crystal metallic articles, comprising:

an investment mold having a main article cavity and having embedded at its lower end below the article cavity and in communication therewith a preformed ceramic single crystal starter insert, said insert having a growth cavity at the bottom with an open bottom end to engage a chill plate during casting and having an upwardly inclined passage connecting the growth cavity to the article cavity, the passage being suitably configured to select a single metallic crystal from the growth cavity for further propagation through the article cavity.

2. The mold of claim 1 wherein the investment mold is a ceramic shell mold.

3. The mold of claim 1 wherein the article cavity is in the shape of a gas turbine engine blade.

4. The mold of claim 1 wherein the starter insert passage is helical in shape.

5. A method for making a ceramic mold for use in casting single crystal metallic articles, comprising:

(a) providing a preformed ceramic single crystal starter insert, said insert having a growth cavity at the bottom with an open bottom end to engage a chill plate during casting, a pattern attachment surface on the end of the insert opposite the growth cavity and an upwardly inclined passage connecting the growth cavity to the pattern attachment surface;

(b) providing a pattern die having an interior cavity in the shape of the article to be cast;

(c) exposing the pattern attachment surface of the insert to the interior cavity of the die and injecting disposable pattern material therein to form an article pattern and simultaneously attach the pattern at said attachment surface atop the starter insert, the upwardly inclined passage of the insert connecting the growth cavity to the article pattern;

(d) forming a ceramic mold around the assembly of starter insert and disposable article pattern by investment molding, leaving the bottom end of the growth cavity open; and (e) removing the disposable article pattern from the invested assembly to provide a mold having an article cavity and a preformed starter insert embedded below the article cavity, the growth cavity of the insert being connected to the article cavity by the upwardly inclined passage.

6. The method of claim 5 wherein molten wax is injected into the pattern die to form a wax pattern and simultaneously unite it with the insert.

7. The method of claim 5 wherein the mold is formed by investment shell molding.

8. The method of claim 6 wherein the wax pattern is removed by heating, the melted wax flowing out of the mold through the open end of the growth cavity.

* * * * *